United States Patent [19]

Huiskes

[11] Patent Number: 4,773,875

[45] Date of Patent: Sep. 27, 1988

[54] ELECTRICAL CONTACT DEVICE AND A METHOD FOR ITS MANUFACTURE

[75] Inventor: Gerardus B. Huiskes, Drachten, Netherlands

[73] Assignee: U.S. Philips Corporation, New York, N.Y.

[21] Appl. No.: 43,901

[22] Filed: Apr. 29, 1987

[30] Foreign Application Priority Data

Apr. 29, 1986 [NL] Netherlands ..... 8601094

[51] Int. Cl.[4] ..... H01R 4/24

[52] U.S. Cl. ..... 439/395

[58] Field of Search ..... 439/391, 395, 417, 418, 439/426

[56] References Cited

U.S. PATENT DOCUMENTS 3,636,500 1/1972 Sedlacek ..... 439/395

4,230,391 10/1980 Keglewitsch ..... 439/395

*Primary Examiner*—Joseph H. McGlynn

*Attorney, Agent, or Firm*—F. Brice Faller

[57] ABSTRACT

The contact device comprises a metal plate (1) with a slot extending to an edge (7) of the plate which separates two strip-shaped, resilient tongues (13) from each other and serves to take up a wire with an electrically conductive core (31) surrounded by an insulating jacket (33). Starting from the said edge (7) the slot successively has a lead-in section (17), a scraper section (21) for cutting through the insulating jacket (33), a contact section (23) for making electrical contact with the core (31), and a circular first opening (5). By pressing a tapered pin (25) into the first opening (5) the tongues (13) are bent away sideways from each other, so that the contact section (23) is approximately V-shaped. The scraper section (21) is formed by the transition between the widest part of the contact section (23) and a second circular opening (9) which is intersected by the slot.

1 Claim, 1 Drawing Sheet

ELECTRICAL CONTACT DEVICE AND A METHOD FOR ITS MANUFACTURE

BACKGROUND OF THE INVENTION

The invention relates to an electrical contact, comprising a metal plate with a slot extending from an edge of the plate, which slot separates two strip-shaped, resilient tongues from each other and serves to take up a wire with an electrically conductive core surrounded by an insulating jacket which is directed approximately perpendicularly to the plane of the plate. The slot successively comprises the following sections: a lead-in section located close to the edge of the plate, the greatest width of which is larger than the diameter of the insulating jacket, a scraper section, the smallest width of which is at most equal to the diameter of the core, a contact section, the width of which is smaller than the smallest width of the scraper section, and an approximately circular first opening at the dead-end of the slot, the diameter of which is greater than the smallest width of the contact section. The invention also relates to a method for manufacturing a contact of this kind.

FR-A-2,113,254 discloses such a contact, manufactured by stamping a slot of the required shape in a metal plate. This slot becomes narrower in steps at the site of the transition between the lead-in section and the contact section, as a result of which a sharp angle is formed, which constitutes the scraper section, which cuts through the insulating jacket when the wire is pressed into the slot. The shape of the slot is determined by the shape of the stamping die. In practice, it has been found that the angle obtained by stamping the scraper section is often slightly rounded, as a result of which the cutting through of the insulating jacket does not always take place optimally. In addition, it often happens that wires which are nominally the same have slightly different core diameters as a consequence of manufacturing tolerances. As a result the contact force, which depends on the core diameter and the width of the contact section, is not always the same. The probability of a good contact can admittedly be increased by positioning two contact devices one behind the other, as described in FR-A-2,133,254, but this entails a substantial increase in costs and does not solve the problem in every case. In addition, a separate die set must be made for each type of wire to be used in order to adapt the width of the scraper section and the contact section to the dimensions of the wire.

SUMMARY OF THE INVENTION

It is an object of the invention to provide a slotted plate contact in which the scraper section is very sharp at all times and in which the contact section is suitable for wires with a core diameter that differs to some extent from the nominal value and, in addition, can be easily adapted to the core diameter of the wire to be used after the slot has been made. For this purpose, the tongues are bent away from each other sideways close to the dead-end of the slot in the plane of the plate, so that the contact section of the slot is approximately V-shaped, and in that the scraper section is formed by the transition between the widest part of the contact section and a second approximately circular opening made in the plate which is intersected by the slot.

In this construction of the contact the width of the contact section can be changed by bending the tongues outwards to a greater or lesser extent. In addition, the width is place-dependent, so that the contact force can be influenced by pressing the wire further or less far into the slot. The scraper section is formed by the transition between the second circular opening and the sheared edges of the contact section. A transition of this kind is always very sharp.

The contact section is manufactured by punching the first and second openings in a suitable metal plate, the tongues then being separated from each other by making a straight cut extending from the edge of the plate via the second opening to the first opening. The tongues are then bent away from each other in the plane of the plate, as a result of which the plate material near the first opening is plastically deformed and the slot acquires its ultimate shape.

The bending away from each other of the tongues can be effected by pressing a tapered pin into the first opening until the width of the slot at the site of the scraper section has reached a predetermined value. The above-mentioned operation can be carried out shortly before the wire is fitted, if required, when the dimensions of this wire and therefore also the required width of the contact section are known precisely.

DETAILED DESCRIPTION OF THE PREFERRED EMBODIMENT

Figure 1:
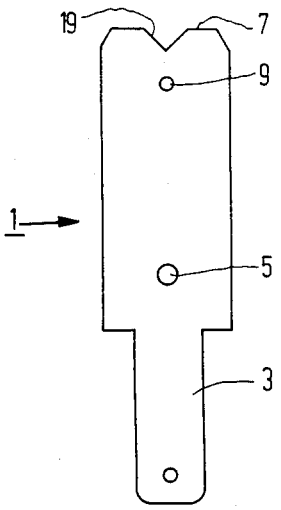
FIGS. 1 to 3 inclusive show three stages in the manufacture of an electrical contact.

FIG. 1 shows a plate 1 which is obtained by a stamping operation from a larger plate or a long strip of metal with resilient properties (for example, phosphor bronze). The plate 1 can be connected by a carrier strip to other plates of similar shape (not shown), so that a consecutive series of plates is available, which can be transported in a customary manner along a row of successive dies. The plate 1 has a relatively narrow section 3 which acts as a connection section of the contact device to be formed and which, in this example, is designed as a flat plug pin. If required, this section can, be designed as a solder lug. In the part of the plate 1 situated above the connection section 3 a first opening 5 is punched close to the connection section and a second opening 9 is punched close to the top edge 7.

Figure 2:
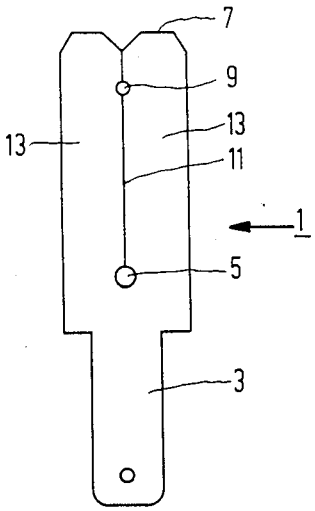

As shown in FIG. 2, a straight cut 11 is made in the plate 1, by shearing along a straight line running from the top edge 7 through the second opening 9 to the first opening 5, where it terminates. Two tongues 13 are formed in the plate 1 on either side of the cut.

Figure 3:
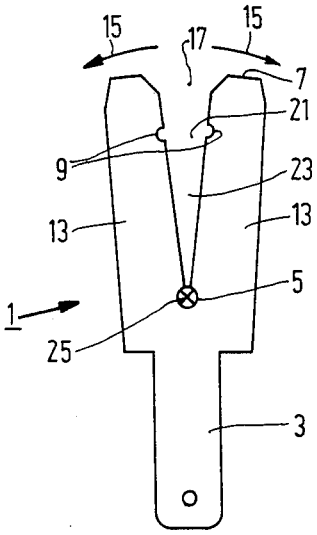

Finally, as shown in FIG. 3, the tongues 13 are bent away from each other in the direction of the arrows 15, while remaining in the plane of the plate 1. During this operation the material of the plate 1 close to the first opening 5 is plastically deformed and the cut 11 takes on the shape of an approximately V-shaped slot, the widest part of which is located close to the edge 7 and the narrowest part close to the first opening 5. This slot comprises a lead-in section 17 located close to the top edge 7 of the plate 1, the shape of which is partly determined by a V-shaped notch 19 (see FIG. 1) formed when stamping the plate 1. In addition, the slot successively contains a scraper section 21 and a contact section 23. The slot comes to a dead end in the first opening 5. The scraper section 21 is formed by the transition between the second opening 9 and the widest part of the contact section 23. At the site of this transition, the cut 11 issue into the second opening 9, sharp angles being formed that project into the slot.

Figure 4:
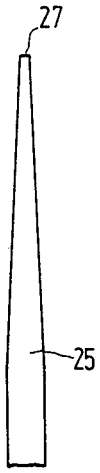
FIG. 4 shows a tool that can be used in the manufacture.

The tongues 13 can be bent apart, by clamping each of these tongues into a suitable tool and then moving these tools away from each other. Preferably, however, this bending is effected by means of a tool comprising a tapered pin 25, as shown in FIG. 4. The pin 25 has a diameter at the free end 27 which is smaller than, the diameter of the first opening 5, the close to the other end being greater than the diameter of the first opening 5. As shown in FIG. 3, the pin 25 is pressed into the first opening 5, as a result of which the tongues 13 are bent apart. The further the pin 25 is pressed into the first opening 5, the further the tongues 13 are bent apart. In this way, the width of the slot, particularly at the site of the scraper section 21, can easily be set very accurately and adapted to the diameter of the core of a wire to be pressed into the slot.

Figure 5:
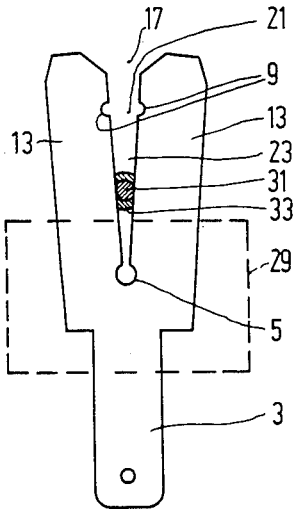
FIG. 5 shows the contact with a wire fitted into it.

FIG. 5 shows a contact into which a wire is fitted. The contact is placed in an electrically insulating housing 29 (indicated schematically with dashed lines). The housing 29 may, for example, be a connector housing or a contact strip fitted to the flange of a coil. The wire, shown in cross-section, which is directed perpendicularly to the plane of the contact device (the plane of the plate 1), has a copper core 31, and an insulating jacket 33, of synthetic material. The wire is pressed into the slot from above, so that it first enters the lead-in section 17. The greatest width of this lead-in section is larger than the diameter of the insulating jacket 33 so that it is sufficient to bring the wire above this lead-in section without great accuracy, after which it is automatically guided to the center of the slot when being pressed further downwards. Next, the wire reaches the scraper section 21, the smallest width of which is at most equal to the diameter of the core 31, so that the insulating jacket 33 is cut through when passing the sharp angles which form the transition between the first opening 9 and the edges of the contact section 23. When the wire is then pressed further into the contact section 23, the edges of this contact section make electrical contact with the core 31, as a result of which this core is slightly deformed and the tongues 13 are elastically pressed outwards. After the wire has stopped against or close to the housing 29, the resilience of the tongues 13 ensures that a good electrical contact is maintained between the core 31 and the contact device. Thanks to the fact that the contact section is V-shaped, a good electrical contact can be made, even when the diameter of the core displays slight deviations with respect to the nominal value. It is only necessary to press thinner wires slightly further and thicker wires slightly less far into the contact section. When contact has to be made with wires which have a different nominal core diameter, the width of the slot can be adapted to this diameter when the tongues 13 are being bent apart by pushing the pin 25 further or less far into the first opening 5. It is thus possible to carry out the necessary stamping and shearing operations in advance and to keep the semi-finished product shown in FIG. 2 in stock. When the wire diameter is known precisely, the last operation described on the basis of FIGS. 3 and 4 can be carried out. No additional stamping dies are needed to produce contacts for various nominal wire diameters and it is also unnecessary to keep contacts with various sized slots in stock. The dimensions are given below of a contact according to the invention which proved to be satisfactory in practice for making contact with a wire, the insulating jacket 33 of which had an external diameter of 0.265 mm and the core a diameter of 0.251 mm:

Material: phosphor bronze sheet with a thickness of 0.5 mm;

Width of the two tongues 13 together before being bent apart: 3.5 mm;

Distance from the top edge 7 to the connection section 3.8 mm;

Distance from the center of the first opening 5 to the top edge 7: 4.9 mm;

Diameter of the first opening 5: 0.7 mm;

Distance from the centre of the second opening 9 to the top edge 7: 1.07 mm;

Diameter of the second opening 9: 0.3 mm;

Distance between the tongues 13 half way along the slot: 0.16 mm.

Under these conditions a good electrical contact was obtained by positioning the wire half way along the slot (approximately 2.6 mm from the top edge 7).

What is claimed is:

1. A method for manufacturing an electrical contact having a V-shaped slot for receiving wire having a conductive core surrounded by an insulative jacket, said method comprising the following steps:

stamping a metal plate with an edge, punching first and second approximately circular openings in said plate, making a straight cut in the plate, said cut running along a straight line from said edge through said second opening and terminating in said first opening, said cut separating two strip shaped tongues, bending said tongues away from each other to form said V-shaped slot by pressing a tapered pin into the first opening until the plate material near the first opening is plastically deformed and the width of the slot at the scraper section has reached a predetermined value, said slot comprising a contact section between the first opening and the second opening, a scraper section at the transition between the contact section and the second opening, and a lead-in section between the second opening and said edge.

* * * * *